US007347898B2

(12) United States Patent
Lin

(10) Patent No.: US 7,347,898 B2
(45) Date of Patent: Mar. 25, 2008

(54) SLIDE HOPPER AND MULTILAYER COATING APPARATUS HAVING THE SAME

(75) Inventor: Jhy-Chain Lin, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/228,592

(22) Filed: Sep. 16, 2005

(65) Prior Publication Data

US 2006/0096529 A1 May 11, 2006

(30) Foreign Application Priority Data

Nov. 5, 2004 (CN) ..... 2004 2 0095013 U

(51) Int. Cl.
*B05C 3/02* (2006.01)

(52) U.S. Cl. ..... 118/411; 118/325; 118/DIG. 2; 118/DIG. 4

(58) Field of Classification Search ..... 118/DIG. 2, 118/DIG. 4, 325, 411, 412, 419; 427/356, 427/294, 420

See application file for complete search history.

(56) References Cited

U.S. PATENT DOCUMENTS 3,508,947 A * 4/1970 Hughes ..... 430/538
3,627,564 A * 12/1971 Mercier ..... 427/358
3,749,053 A * 7/1973 Timson ..... 118/50
3,958,532 A * 5/1976 Timson ..... 118/62
4,842,900 A * 6/1989 Miyamoto ..... 427/348
5,275,660 A * 1/1994 Ozaki et al. ..... 118/411

FOREIGN PATENT DOCUMENTS

CN 01100242.5 8/2001

* cited by examiner

*Primary Examiner*—Brenda A. Lamb
(74) *Attorney, Agent, or Firm*—Jeffrey T. Knapp

(57) ABSTRACT

The present coating system (100) provides a multilayer coating apparatus for coating an object (112). The multilayer coating apparatus includes a slide hopper (116, 140). The slide hopper includes a main body (116, 140), the main body essentially including a plurality of separate cavities (118, 120, 122) for receiving coating materials, a plurality of separate slots (124, 126, 128) in communication with the corresponding cavities, and a plurality of separate projection portions (130, 132, 134) formed on the slide hopper, the projection portions each having a substantially sloping slide surface (131, 133, 135) configured for allowing the particular coating material exiting from the slot to directly flow onto the object.

9 Claims, 2 Drawing Sheets

SLIDE HOPPER AND MULTILAYER COATING APPARATUS HAVING THE SAME

BACKGROUND OF THE INVENTION

1. Field of the Invention

The present invention relates to multi-layer coating apparatuses and, particularly, to a multilayer coating apparatus for delivering coating materials to a surface of an object.

2. Discussion of the Related Art

A coating apparatus is for applying a coating material onto a surface of an object. The coating apparatus is usually required to be capable of controlling a flux or other coating material flowing to the surface, a flow velocity, a relative moving velocity between the surface of the object and the coating apparatus, and a distance between the object and the coating apparatus, in order to control a thickness of the coating material formed on the object and to distribute the coating material evenly on the surface of the object. In general, in many circumstances, a plurality of layers of the various coating materials is required to be coated/formed on an object. For example, a photosensitive composite film stack usually includes nine or more layers of materials. Thus, a multilayer coating apparatus that is capable of simultaneously coating a plurality of layers of materials is demanded.

In order to improve the coating quality, many modifications have been made to the coating apparatus. For example, an unfluctuating rolling edge has been proposed to sustain a flux of the liquid flowing on the slide surface, and/or an inhaled air removal device has been devised for eliminating an excess of inhaled air brought into the coating area by the moving object.

Slide hoppers are often employed in such multilayer coating apparatuses for supplying and guiding the coating materials to flow onto a surface of an object. A conventional slide-hopper-type, multilayer coating apparatus having a slide/extrusion hopper is adapted for dispensing a liquid composition onto a moving object. Such coating apparatuses generally can be categorized into a slide-rolling-edge type and a slide-curtain type.

China Patent Application No. 01100242.5 discloses a slide rolling edge type, multilayer coating apparatus and a slide curtain type, multilayer coating apparatus. In accordance with that application and referring to FIG. 3, the slide rolling edge type, multilayer coating apparatus 10 is illustrated. The slide rolling edge type, multilayer coating apparatus 10 includes a slide hopper 16 and a roller spindle 34. An object 12 to be coated is wound on the outer circumference of the roller spindle 34 and is driven to jointly rotate with the roller spindle 34. Coating materials 14A, 14B and 14C are forced to flow from corresponding material containers (not shown) to corresponding cavities 18, 20 and 22 by corresponding pumps (not shown). The coating materials 14A, 14B and 14C extend breadthwise to a predetermined width. The coating materials 14A, 14B and 14C are extruded through corresponding slots 24, 26 and 28. The coating materials 14A, 14B and 14C are then combined into a multilayer composite coating material 14 on a slide surface 30. The multilayer composite coating material 14 flows down along a projection portion 32 of the slide surface 30, forming a rolling coating material edge 36 bounded by the projection portion 32 and the moving object 12. Herein, an inhaled air removal device 38 is employed to remove the air brought/carried by the moving object 12 and to thereby stably sustain the rolling edge 36. Therefore, a multilayer coating film A is formed on the moving object 12.

FIG. 4 illustrates a slide curtain type coating apparatus 10', as per the above-referenced application. The slide curtain type coating apparatus 10' is similar to the slide rolling edge type, multilayer coating apparatus 10, as illustrated in FIG. 3. However, in the case of the slide curtain type coating apparatus 10', the projection portion 32 of the slide surface is located farther away from the object 12 to be coated, when considered relative to the projection portion 32 of the slide rolling edge type coating device 10. The multilayer composite coating material 14 falls in the form of a curtain from the projection portion 32 of the slide surface 30 to the object 12. The multilayer composite coating material 14 is then extended to form a multilayer coating film A. A pair of guiding means 44 is disposed for guiding the falling multilayer composite coating material 14. An inhaled air removal device 46 is disposed and configured for removing the air brought/carried by the moving object 12 and for thereby promoting the formation of an even coating on the object 12.

The foregoing moving objects 12 to be coated may, for example, be ordinary papers, plastic films, resin half-tone papers or a composite papers, or potentially a flexible electronic substrate material. The coating materials 14A, 14B and 14C generally comprise emulsion, surface-active agents, and/or viscosity enhancing agents, as well as, of course, the primary coating material(s).

However, the aforementioned multilayer composite material 14 is formed on the slide surface 30 of the slide hopper 16 prior to being coated onto the object 12. Therefore, mutual diffusion between the coating materials 14A, 14B and 14C can inevitably occur. This mutual diffusion may adversely impair the coating quality.

Accordingly, a multilayer coating apparatus and a related method are needed in the art which can avoid the potential mutual diffusion of coating materials prior to their being coated on the object.

SUMMARY

The present invention provides a multilayer coating apparatus for coating an object. The multilayer coating apparatus includes a slide hopper. The slide hopper has a main body, the main body essentially including a plurality of separate cavities for receiving coating materials, a plurality of separate slots in communication with the corresponding cavities, and a plurality of separate projection portions formed on the slide hopper. The projection portions each have a substantially sloping slide surface configured for allowing the coating material exiting from the slot to directly flow onto the object.

Compared with the conventional technologies, the multilayer coating apparatus according to the present invention delivers coating materials to the surface to be coated via a plurality of independent slide surfaces. Since these slide surfaces are independent of each other, diffusion between coating materials before they reach to the surface to be coated can mostly be avoided, thus improving coating quality.

Other advantages and novel features will become more apparent from the following detailed description when taken in conjunction with the accompanying drawings.

BRIEF DESCRIPTION OF THE DRAWINGS

Many aspects of the present coating system and the method of its use can be better understood with reference to the following drawings. The components in the drawings are not necessarily to scale, the emphasis instead being placed upon clearly illustrating the principles of the present coating system and its use. Moreover, in the drawings, like reference numerals designate corresponding parts throughout the several views.

Figure 1:
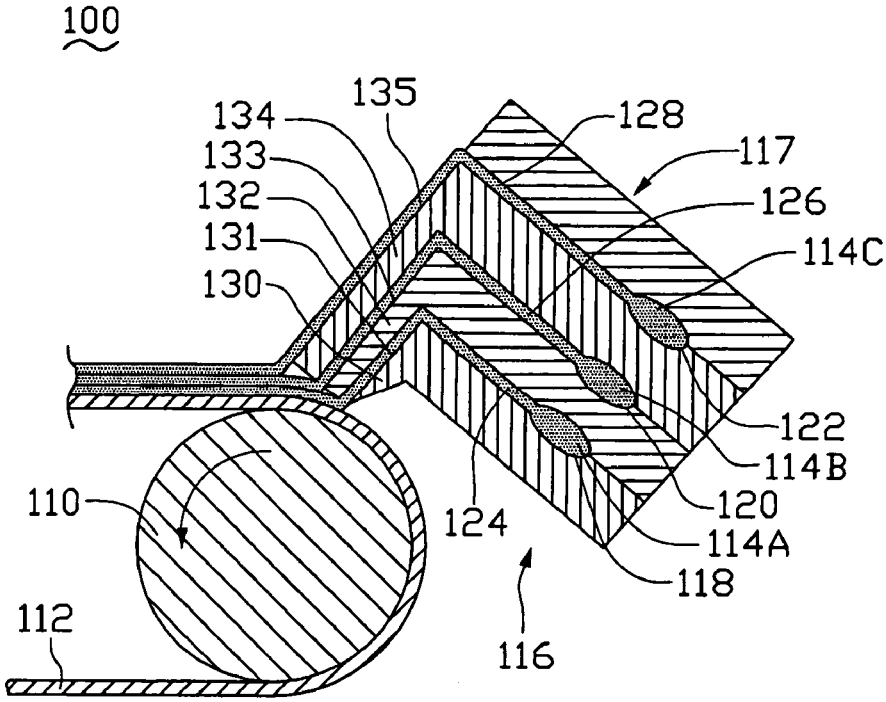
FIG. 1 is a schematic cross-sectional view of a slide rolling edge type, multilayer coating apparatus according to a preferred embodiment of the present coating system.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE PREFERRED EMBODIMENTS

Referring now to FIG. 1, a multilayer coating apparatus 100 according to a preferred embodiment of the present coating system is shown. The multilayer coating apparatus 100 includes a slide hopper 116 and a roller spindle 110. An object 112 to be coated is wound on the outer circumference of the roller spindle 34 and is driven to move jointly with the roller spindle 110. The slide hopper 116 has a main body 117 that generally includes a plurality of cavities 118, 120 and 122 and has a plurality of slots 124, 126 and 128 defined therein. The cavities 118, 120 and 122 are respectively configured for accommodating coating materials 114A, 114B and 114C.

The slide hopper 116 further comprises a plurality of flat projection portions 130, 132 and 134 located on the top thereof, respectively corresponding to and communicating with the slots 124, 126 and 128. The flat projection portions 130, 132 and 134 correspondingly have associated sloping slide surfaces 131, 133 and 135. The plurality of slots 124, 126 and 128 are, respectively, in fluid communication with the corresponding cavities 118, 120, 122. The coating materials 114A, 114B and 114C can be forced to flow into the cavities 118, 120 and 122 from corresponding containers (not shown) by flux controlling pumps (not shown). Widths of the slots 124, 126 and 128 are advantageously equal (or at least approximately so, depending on the degree of precision required) to the width of the surface to be coated (or as the case may be, to the width of the portion of the surface desired to be coated).

The object 112 wound on the roller spindle 110 is driven to move jointly therewith. The ends of the flat projection portions 130, 132 and 134 are preferably disposed as close as possible to the surface of the object 112 to facilitate the formation of a uniform and even coating on the object 12. Upon being respectively extruded from the slots 124, 126 and 128, the coating materials 114A, 114B and 114C, under a gravitational force acting thereon, flow along the corresponding slide plane surfaces 131, 133 and 135 to the lower ends of the projection portions 130, 132 and 134. Thus, the coating materials flow separately prior to be coated on the object 112. Therefore, mutual diffusion between the coating materials, prior to reaching the object to be coated, is effectively eliminated.

Figure 2:
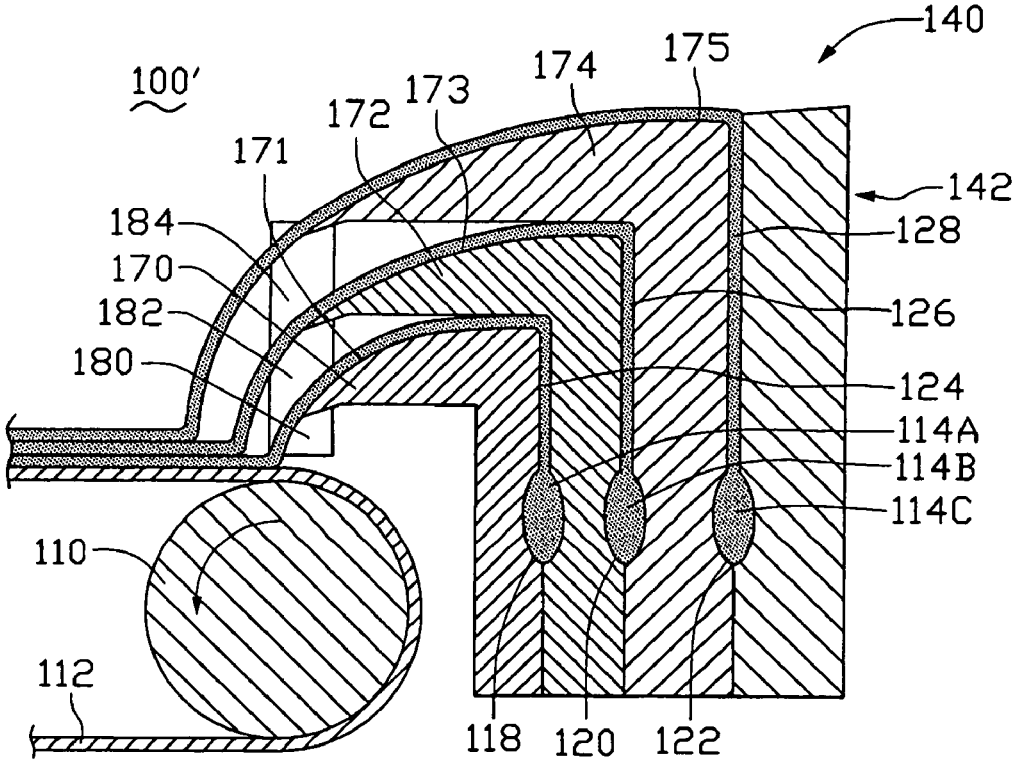
FIG. 2 is a schematic cross-sectional view of a multilayer coating apparatus according to another preferred embodiment of the present coating system.

FIG. 2 shows a multilayer coating apparatus 100' for coating an object 112 according to another preferred embodiment of the present coating system. The multilayer coating apparatus 100' includes a slide hopper 140 and a roller spindle 110. An object 112 is wound on the outer circumference of the roller spindle 34 and is driven to move jointly with the roller spindle 110. The slide hopper 140 has a main body 142 that generally includes a plurality of cavities 118, 120 and 122 and has a plurality of slots 124, 126 and 128 defined therein. The slots 124, 126 and 128 are respectively in fluid communication with the cavities 118, 120, 122. The plurality of cavities 118, 120 and 122 are respectively configured for accommodating coating materials 114A, 114B and 114C.

The slide hopper 140 further comprises a plurality of curved projection portions 170, 172 and 174 located on the top of the slide hopper 140. These curved projection portions 170, 172 and 174 respectively correspond to and fluidly communicate with the slots 124, 126 and 128. The curved projection portions 170, 172 and 174 each have sloping curved slide surfaces 171, 173 and 175 for guiding coating materials 114A, 114B and 114C to flow toward the object 112.

The coating materials 114A, 114B and 114C are forced to flow from corresponding containers (not shown) to the cavities 118, 120 and 122 by means of flux controlling pumps (not shown). Widths of the slots 124, 126 and 128 are substantially equal to a width of the to-be-coated surface of the object 112 (or to the width of portion thereof to be coated, as the case may be). Guiding means 180, 182 and 184 are additionally provided and are configured to allow the coating materials 114A, 114B and 114C to smoothly flow from the projection bent slide edges 170, 172 and 174 onto the surface of the object 112. The object 112 is wound on and driven by a roller 110.

Upon being extruded from the slots 124, 126 and 128, the coating materials 114A, 114B and 114C, under the gravitational force acting thereon, flow along the corresponding slide curving surfaces 171, 173 and 175 to corresponding lower ends of the bent slide edges 170, 172 and 174. Thereafter, the coating materials 114A, 114B and 114C, being guided by the guiding means 180, 182, and 184, fall down to the surface of the object to be coated 112. Thus, the coating materials flow separately prior to being coated on the object 112. Therefore, mutual diffusion, prior to reaching the object to be coated, is effectively avoided.

Figure 3:
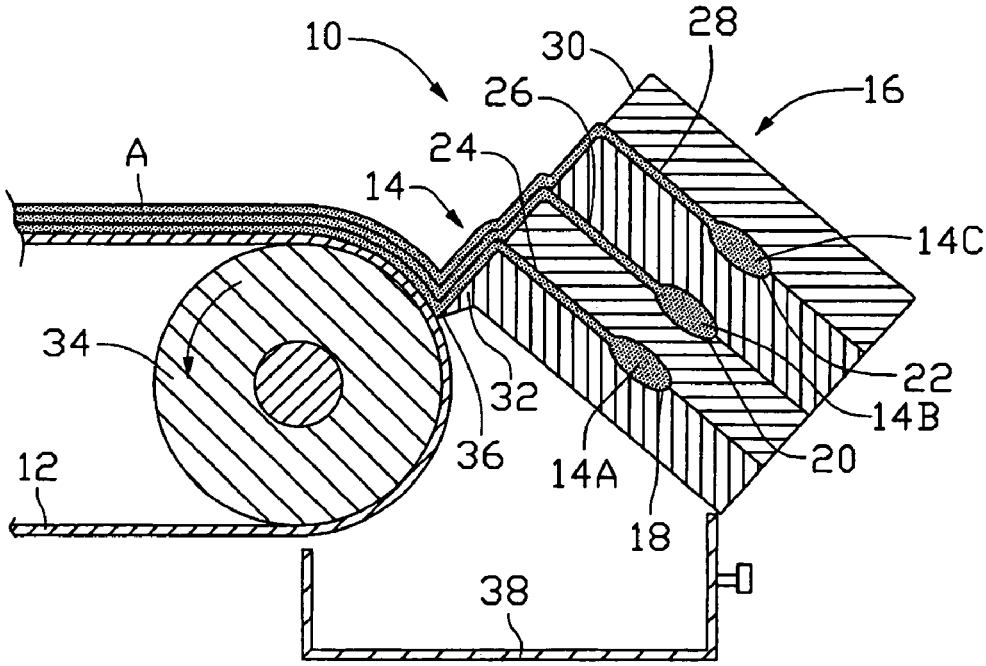
FIG. 3 (PRIOR ART)
FIG. 3 is a schematic cross-sectional view of a conventional multilayer coating apparatus.
Figure 4:
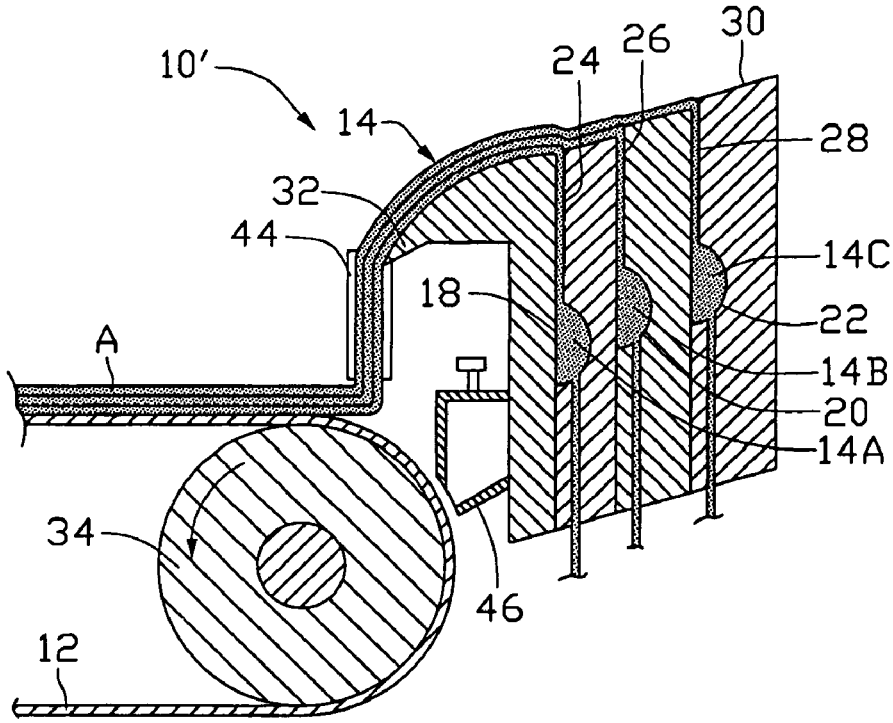
FIG. 4 (PRIOR ART)
FIG. 4 is a schematic cross-sectional view of another conventional multilayer coating apparatus.

According to another aspect of the foregoing embodiments, the slide hoppers 116 and 140 can advantageously be made of any of various ceramic materials or ceramic-based composites, including oxide ceramics, such as $Al_xO_y$, $Zr_xO_y$, $Mg_2SiO_4$, and $ZrSiO_x$; nitride ceramics such as $Si_xN_y$, $Ti_xN_y$, $Al_xN_y$, and $B_xN_y$; and carbide ceramics such as $Si_xC_y$, $Ti_xC_y$, $W_xC_y$, and $Cr_xC_y$; and composites composed substantially of at least one of such materials. In addition, an inhaled air removal device, such as those illustrated in FIGS. 3 and 4, may also be employed with the present embodiments of the coating system in order to remove the air brought/carried by the object 112.

It is to be further understood that the above-described embodiments illustrate the scope of the invention but do not restrict the scope of the invention. Variations may be made to the embodiments without departing from the spirit or scope of the invention as claimed herein.

What is claimed is:

1. A slide hopper for a multilayer coating apparatus for coating an object, the slide hopper comprising:

a main body, the main body having a plurality of separate cavities configured for receiving respective coating materials therein, the main body further including a plurality of separate slots in fluid communication with the corresponding cavities;

a plurality of separate projection portions formed on the main body, the projection portions each having a substantially sloping slide surface configured for allowing the respective coating material to exit from the corresponding slot, the projection parts being spaced apart from one another in a manner so as to cause the coating materials to separately flow toward the object; and a plurality of guiding means configured for guiding the respective coating materials to separately flow from the slide surfaces to the surface of the object.

2. The slide hopper as described in claim 1, wherein the main body is made of one of a ceramic material and a ceramic-based composite.

3. The slide hopper as described in claim 2, wherein the one of a ceramic material and a ceramic-based composite is selected from the group consisting of $Al_xO_y$, $Zr_xO_y$, $Mg_2SiO_4$, ZrSiO, $Si_xN_y$, $Ti_xN_y$, $Al_xN_y$, $B_xN_y$, $Si_xC_y$, $Ti_xC_y$, $W_xC_y$, and $Cr_xC_y$; and composites substantially of at least one of such materials.

4. The slide hopper as described in claim 1, wherein at least one slide surface is curved.

5. A multilayer coating apparatus for coating an object, the multilayer coating apparatus comprising:

a slide hopper comprising:

a main body, the main body including:

a plurality of separate cavities formed therein, each cavity being configured for receiving a corresponding coating material therein;

a plurality of separate slots, each slot being in fluid communication with a corresponding cavity; and a plurality of separate projection portions formed on the main body, each projection portion corresponding to a respective slot in the main body, the projection portions each having a substantially sloping slide surface configured for allowing the respective coating material exiting from the corresponding slot, the projection parts being spaced apart from one another in a manner so as to cause the coating materials to separately flow toward the object;

a plurality of guiding means configured for guiding the respective coating materials to separately flow from the slide surfaces to the surface of the object; and a roller spindle configured for winding an object therearound and driving the object to move jointly therewith.

6. The multilayer coating apparatus as described in claim 5, wherein the main body is made of one of a ceramic material and a ceramic-based composite.

7. The multilayer coating apparatus as described in claim 6, wherein the main body is comprised of at least one material selected from the group consisting of $Al_xO_y$, $Zr_xO_y$, $Mg_2SiO_4$, $ZrSiO_y$, $Si_xN_y$, $Ti_xN_y$, $Al_xN_y$, $B_xN_y$, $Si_xC_y$, $Ti_xC_y$, $W_xC_y$, and $Cr_xC_y$.

8. The multilayer coating apparatus as described in claim 6, wherein at least one slide surface is curved.

9. The multilayer coating apparatus as described in claim 6, further comprising an inhaled air removal device configured for removing air carried by the object.

* * * * *